US005327611A

United States Patent [19]

Balster et al.

[11] Patent Number: 5,327,611

[45] Date of Patent: Jul. 12, 1994

[54] HAIR BRUSH

[75] Inventors: Melvin E. Balster, Minnetonka; Delton A. Kruschke, Apple Valley, both of Minn.

[73] Assignee: Mebco Industries, Inc., Shakopee, Minn.

[21] Appl. No.: 41,753

[22] Filed: Apr. 2, 1993

[51] Int. Cl.[5] ..... H05F 3/00; A46B 9/08

[52] U.S. Cl. ..... 15/176.4; 15/160; 15/187; 15/202

[58] Field of Search ..... 15/159.1, 160, 176.1, 15/176.4, 176.5, 187, 202, 186, 180; 132/313, 120, 121

[56] References Cited

U.S. PATENT DOCUMENTS

| | | | |
|---|---|---|---|
| 502,513 | 8/1893 | Giesecke | 15/159.1 |
| 3,134,121 | 5/1964 | Wachtel | 15/176.1 |
| 4,500,939 | 2/1985 | Gueret | 15/187 |

FOREIGN PATENT DOCUMENTS

| | | | |
|---|---|---|---|
| 1103290 | 3/1961 | Fed. Rep. of Germany | 15/176.1 |
| 0428661 | 7/1967 | Switzerland | 15/176.4 |

OTHER PUBLICATIONS

PCT/US79/00782; WO80/01135 Jun. 12, 1980 Battaglia.

PCT/GB84/00333; WO85/01422 Apr. 11, 1985 Steadman et al.

*Primary Examiner*—Timothy F. Simone
*Assistant Examiner*—Reginald L. Alexander
*Attorney, Agent, or Firm*—Kinney & Lange

[57] ABSTRACT

A snap-together, two piece, injection molded hairbrush includes a brush body and a bristle insert. The brush body includes a head and a handle. The head has a first and second end and a first and second side. The first and second ends and first and second sides form an open frame and a plurality of ribs extend between the first and second ends to define a first set of air slots. The handle has first and second ends and the first end of the handle is attached to the second end of the head. The bristle insert includes an open frame, a plurality of convex webs, a plurality of spaced bristles, and a connector. The open frame has first and second sides and first and second ends. The plurality of convex webs extend between the first and second sides of the open frame and are spaced from one another to define a second set of air slots. The plurality of spaced bristles are carried on each of the webs and extend outward from the webs. The connector mates with the frame of the head to connect the bristle insert to the head.

13 Claims, 6 Drawing Sheets

HAIR BRUSH

BACKGROUND OF THE INVENTION

The present invention relates to hairbrushes. In particular, the present invention is a two-piece molded hairbrush which includes a brush body and a bristle insert.

The most common type of bristle for hairbrushes is the nylon tufted bristle. Nylon tufted bristles are made by tufting pieces of nylon into holes which have been drilled or molded into the head of the brush. The tufting process is similar to sewing. This process is repeated for each individual bristle throughout the entire brush head. Nylon tufted bristles have significant advantages in that they tend to be quite flexible and have excellent memory. Memory, which refers to the ability of the bristles to return to their original position after being bent out of shape, is important for the longevity of the hairbrush. Flexibility is important for overall comfort of the brush on the scalp. The bristles will tend to bend away from rather than stab into the scalp surface.

Although nylon tufted bristles have these advantages, they also present significant shortcomings. First, when the bristle is tufted, some tufting processes require that a secondary short stub is left at the base of the bristle. Thus, the hairbrush tends to trap pieces of hair between the short stub and the actual bristle. This tears hair as it passes through the brush. Second, nylon tufted bristles tend to have an area of space between the bristle and the brush block. Typically, the nylon bristle does not fit tightly in the hole of the brush block into which it is tufted, that is, the diameter of the hole in the brush block is larger than the diameter of the nylon bristle. Thus, the area between the nylon bristle and the brush block tends to trap and tear hair. Third, brushes made using nylon tufted bristles tend to leave lines in the hair on which the brush is used. This occurs because the nylon bristles need to be anchored into the brush block. When the brush block has been vented, the area available to anchor these bristles will quite often be in a straight row. When the bristles are in rows one bristle merely passes directly behind another bristle leaving rows in the hair. Although some attempts have been made to curve the vents in the brushes to prevent the bristles from being in a straight row, these attempts have not been successful overall.

Costs are also a significant limitation in the manufacturing of nylon tufted brushes. Nylon itself is an expensive material. In addition, there are extensive time expenditures in manufacturing nylon tufted brushes. Each bristle must be tufted into the brush block individually, which greatly increase the cost of manufacture.

Alternative hairbrush designs include molded bristle brushes. These brushes remedy significantly some of the shortcomings of the nylon tufted brushes. For example, the bristles on the molded bristle brushes can be angled so that no straight lines will be left in the hair on which the brush is used. Also, no short stub pieces are left on the base of the bristles so that hair will not tend to tear as it moves through the bristles.

However, molded bristle brushes have significant shortcomings of their own. For example, they have poor memory and poor flexibility. Of course, this is true of brushes not molded with nylon. If the brushes are molded with nylon then memory is good but the expense is more than most consumers will pay. When the bristles of (non-nylon) molded brushes are bent out of shape, they tend to stay in that shape rather than to return to their original shape. They also have poor flexibility so that bristles tend to poke into a scalp rather than bend away from it. This is because of the one piece or solid block construction which gives no cushion for the bristles. This leads to a lack of comfort and also causes the bristles to break rather than bend when they impact surfaces. The bristles also tend to tear hair rather than give way to it.

There is continuing need for a hairbrush that remedies the shortcomings of both the nylon tufted brushes and the molded bristle brushes.

SUMMARY OF THE INVENTION

The present invention is a two-piece molded hairbrush comprising a brush body and a bristle insert. The brush body includes a head and a handle. The head has first and second ends and first and second sides which form an open frame. A plurality of ribs extend between the first and second ends to define a first set of air slots. The handle has first and second ends with the first end of the handle attached to the second end of the head. The bristle insert includes an open frame, a plurality of convex webs, a plurality of bristles, and a connector. The open frame has first and second sides and first and second ends. The plurality of convex webs extend between the first and second sides of the open frame. The webs are spaced from one another to define a second set of air slots. The plurality of bristles are spaced along each of the webs extending outward from the webs. The connector of the bristle insert mates with the frame of the head to connect the bristle insert to the head.

DETAILED DESCRIPTION OF THE PREFERRED EMBODIMENTS

Figure 1:
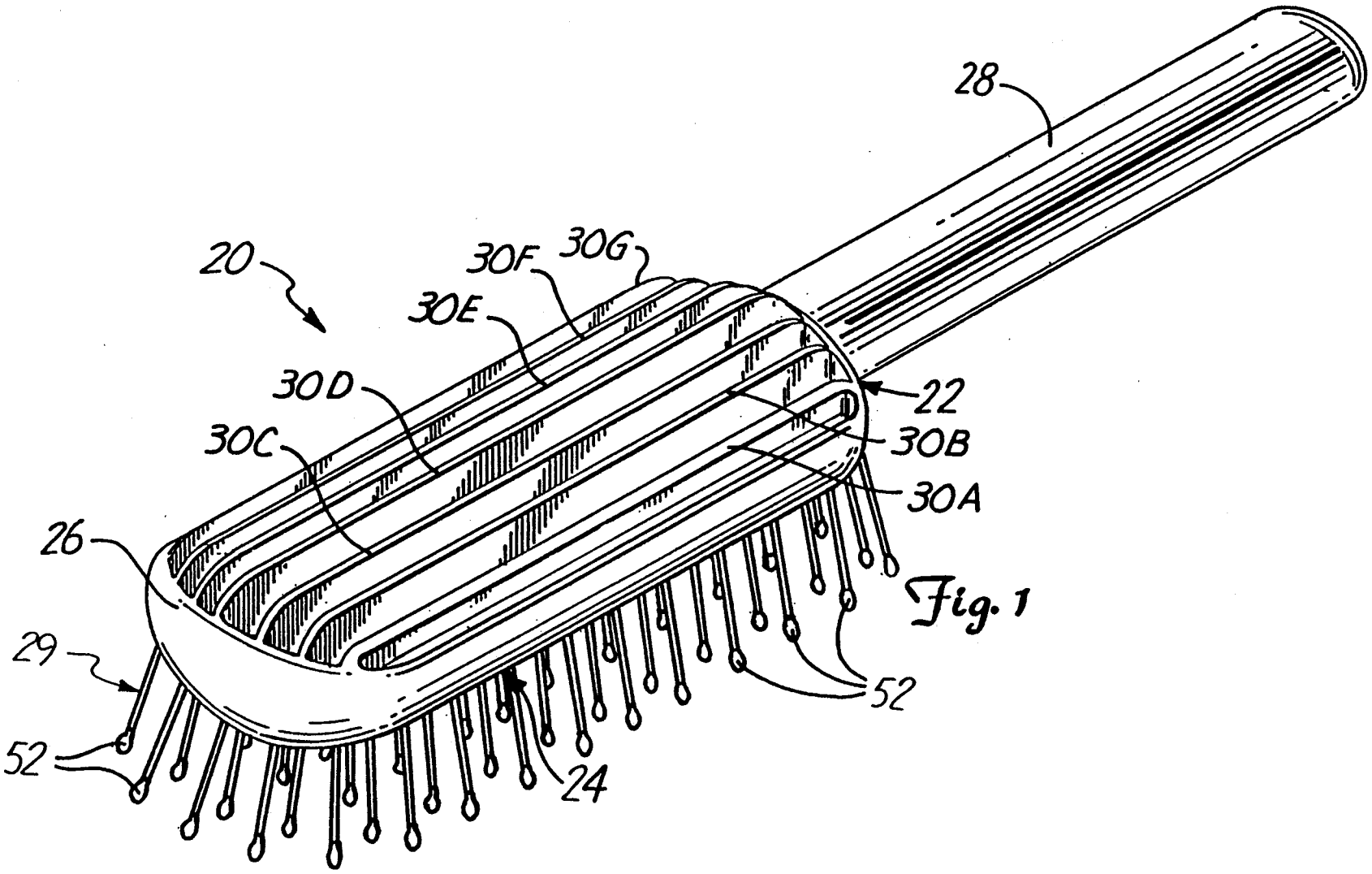
FIG. 1 is a perspective view of a hairbrush in accordance with the present invention.

FIGS. 1 through 4 show various views of hairbrush 20 of the present invention. FIG. 1 shows a perspective view of hairbrush 20. Hairbrush 20 comprises brush body 22 and bristle insert 24. Brush body 22 consists of head 26 and handle 28. Bristle insert 24 carries bristles 29.

Figure 2:
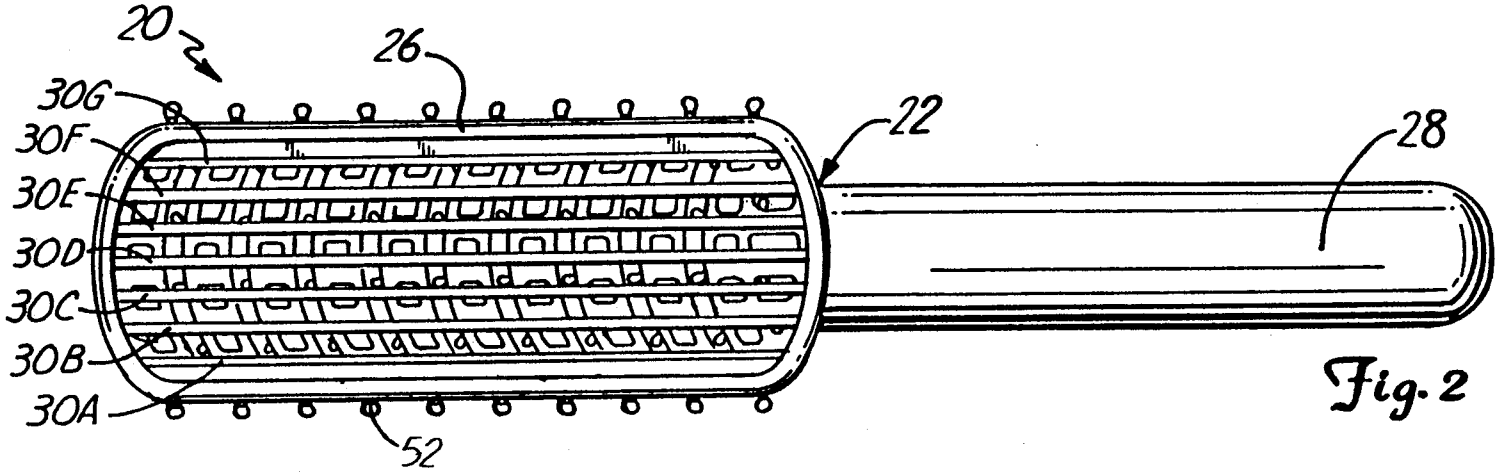
FIG. 2 is a top view of a hairbrush in accordance with the present invention.
Figure 3:
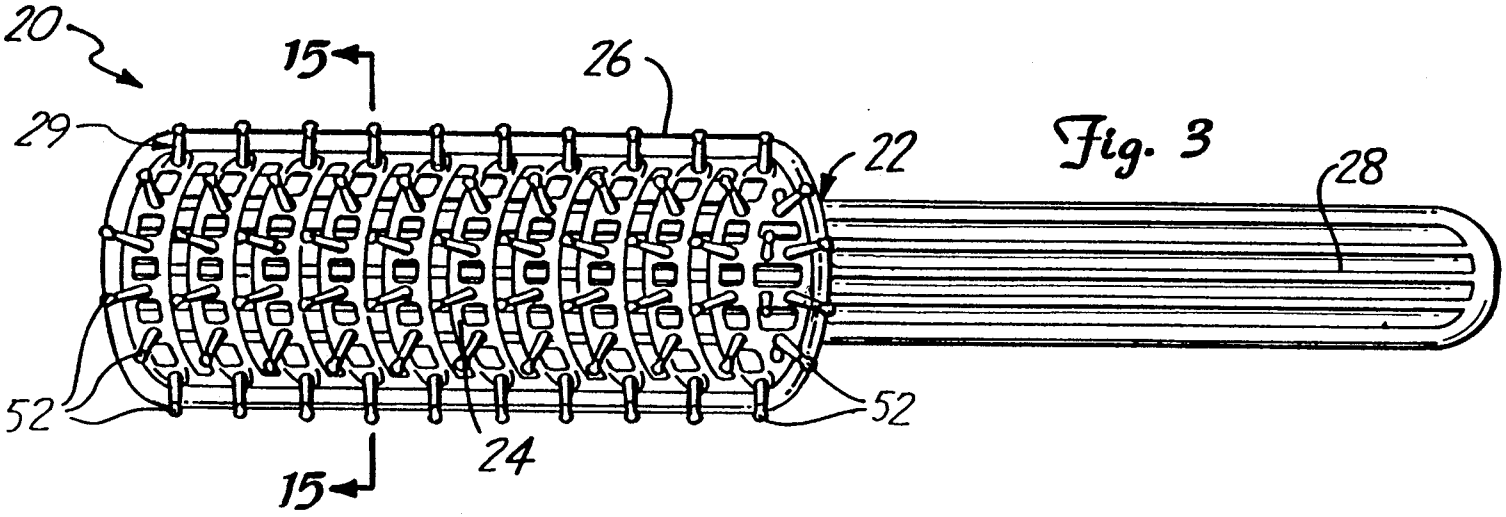
FIG. 3 is a bottom view of a hairbrush in accordance with the present invention.
Figure 4:
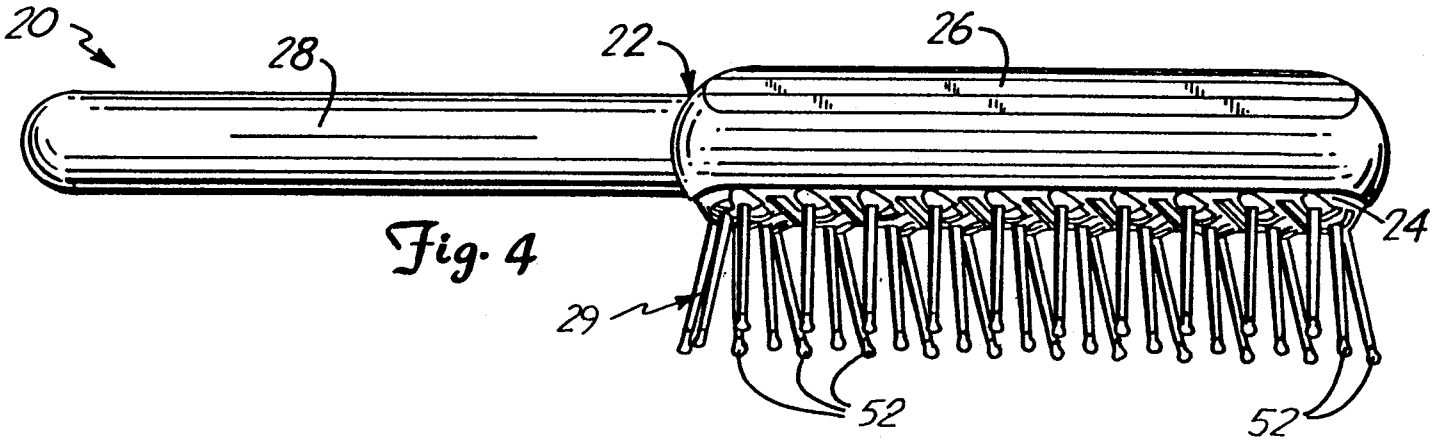
FIG. 4 is a side view of a hairbrush in accordance with the present invention.

FIGS. 2, 3, and 4 are a top view, a bottom view, and a side view of hairbrush 20, respectively. Each of the figures show brush body 22 interconnected with bristle insert 24. Brush body 22 consists of head 26 and handle 28. In FIG. 2, ribs 30A–30G are shown in brush body 22. In FIGS. 1, 3 and 4, bristles 29 are shown extending from bristle insert 24.

Hairbrush 20 is held in a hand of the user by handle 28 while bristle insert 24 is run across the hair of the user. Hairbrush 20 is oriented so that the bottom side of bristle insert 24 which carries bristles 29, as shown in FIG. 3, is proximate to the hair of the user.

Hairbrush 20 has a two piece molded plastic construction in which brush body 22 and bristle insert 24 snap together. Each of these two pieces is injection molded individually as a unit. No structural element of either brush body 22 or bristle insert 24 is added on after the molding process. Thus, the brush is lower in cost to manufacture and less likely to be damaged structurally.

One embodiment of the present invention brush body 22 and bristle insert 24 are formed by injection molded polypropylene or a polypropylene/elastomer alloy. This material has the advantage of being less expensive than more commonly used materials like nylon. Thus, the overall cost of manufacturing hairbrush 20 is significantly less than comparable brushes even when only material costs are considered. Yet, as described in more detail later, hairbrush 20 provides performance which is equal or superior to the prior art nylon tufted bristle brushes. Hairbrush 20 also has an open vented construction to ensure superior performance when used with a hair dryer.

Figure 5:
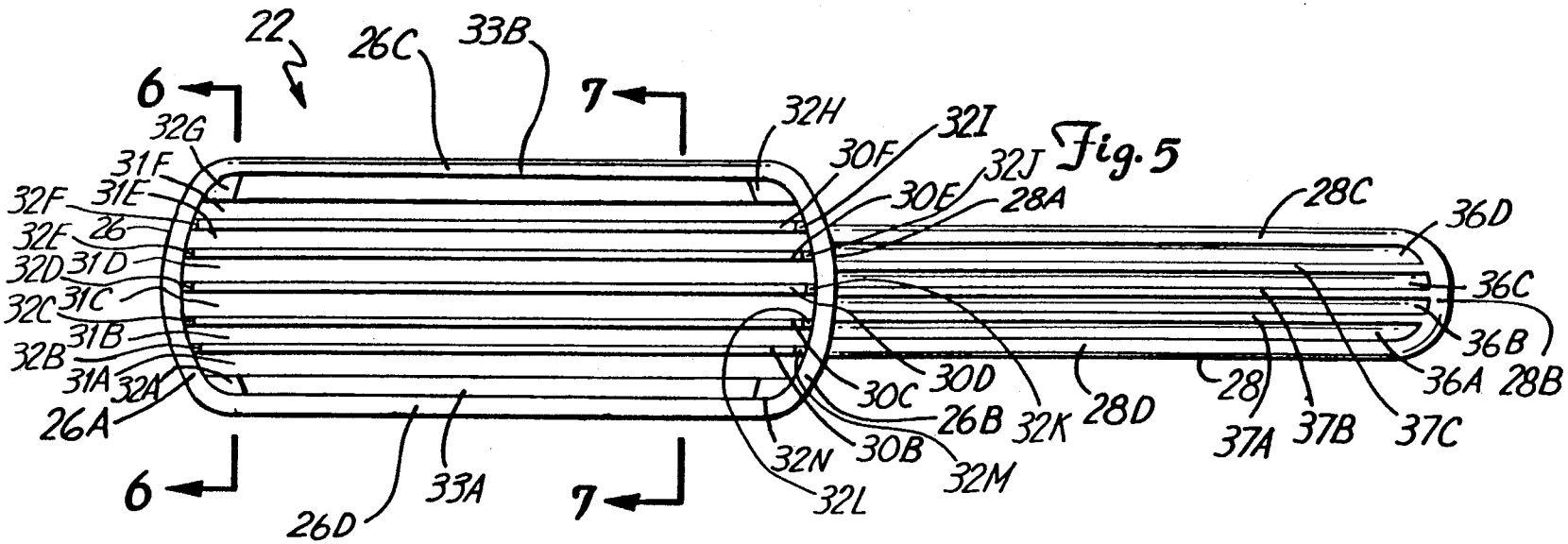
FIG. 5 is a bottom view of the brush body in accordance with the present invention.

FIG. 5 is a bottom view of brush body 22 in accordance with the present invention. Brush body 22 includes integrally injection molded head 26 and handle 28. Head 26 has ends 26A and 26B and sides 26C and 26D. Handle 28 has ends 28A and 28B and sides 28C and 28D. End 26B of head 26 is connected to end 28A of handle 28. In one embodiment, head 26 is 1.70 inches wide, i.e., between sides 36C and 36D, and 4.41 inches long, i.e., between ends 26A and 26B. Handle 28 is 0.72 inches wide and 4.00 inches long.

Head 26 includes parallel ribs 30A–30G, airslots 31A–31F, steps 32A–32N, and shelves 33A and 33B. Rib 30A is adjacent side 26D of head 26 and extends between ends 26A and 26B of head 26. Ribs 30B–30G also extend between ends 26A and 26B of head 26. Ribs 30B–30G each are spaced a distance away from rib 30A toward side 26C of head 26. Rib 30B is closest to rib 30A and rib 30G is farthest away from rib 30A. Rib 30G is adjacent side 26C of head 26.

Ribs 30A–30G are spaced from each other between sides 26C and 26D of head 26 to create a first set of longitudinal air slots 31A-31F. Longitudinal air slots 31A–31F are important to the overall function of hairbrush 20 in that air is allowed to flow through it from one side to the other. In this way, air can be blown through head 26 and more directly onto the hair of the user. This ensures faster drying when hairbrush 20 is used in conjunction with a hair dryer. Ribs 30A-30G are also important in that they give structural support to head 26, while minimizing the amount of plastic needed to form head 26 and thus the weight and cost of head 26.

Shelf 33A is between rib 30A and side 26D. Shelf 33A is flush with the bottom side of rib 30A. In this way, the bottom surface of rib 30A is extended into side 26D. Similarly, shelf 33B is between rib 30G and side 26C. Shelf 33B is also flush with the bottom surface of rib 30G so that the bottom surface of 30G extends into side 26C. Shelves 33A and 33B provide a surface against which bristle insert 24 will rest when bristle insert 24 and head 26 are interconnected.

Steps 32A–32N are on the bottom side of ribs 30A–30G and shelves 33A and 33B. Steps 32A–32N have a height so that they extend below the bottom surface of ribs 30A–30G. The heights of steps 32A–32N are the same so that the bottom surface of each is level with each other. Step 32A is connected in a corner of head 26 so that it is attached to shelf 33A, rib 30A, side 26D, and end 26A. Steps 32B through 32F are connected to ribs 30B–30F, respectively. Steps 32B–32F are attached to the ribs at end 26A. Step 32G is connected in a corner of head 26 so that it is attached to shelf 33B, rib 30G, side 26C, and end 26A.

Step 32H is connected in a corner of head 26 so that it is attached to shelf 33B, rib 30G, side 26C, and end 26B. Steps 321'432M are connected to ribs 30F–30B, respectively. Steps 321–32M are connected toward the end of the ribs so that they are attached to side 26B. Step 32N is connected in a corner of head 26 so that it is attached to shelf 33A, rib 30A, side 26D, and end 26B.

Handle 28 includes slots 36A, 36B, 36C and 36D and fins 37A, 37B and 37C. Slots 36A through 36D each extend between ends 28A and 28B of handle 28 spaced a distance apart leaving raised fins between each slot. Fins 37A–37C are shown alternated with slots 36A–36D. Each slot has a depth less than the height of handle 28 so that none of the slots extend all the way through handle 28. Slots and fins are evenly alternated between sides 28C and 28D on handle 28.

The alternating of slots 36A–36D with fins 37A–37C in handle 28 ensures that hairbrush 20 provides a firm grip to the user. When a user's fingers are wrapped around handle 28, leverage is obtained on fins 37A–37C which are created by alternating slots 36A-36D. If the surface of handle 28 were entirely smooth, such a firm grip would not be possible. This is especially true when handle 28, or the user's hand, is wet. In addition, slots 36A–36D also reduce the amount of plastic used in the handle 28—which reduces cost and weight. Finally, slots 36A–36D carry on the same theme of the alternating ribs of head 26 which appeal to the overall aesthetics of hairbrush 20.

Figure 6:
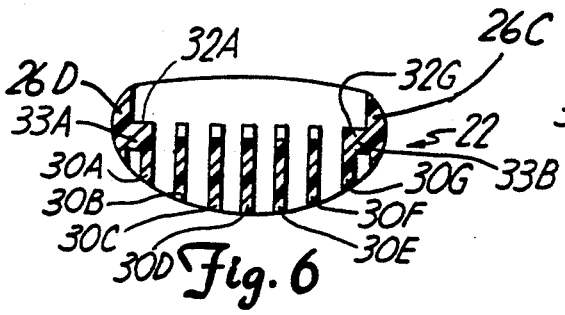
FIG. 6 is a sectional view as seen from line 6—6 of FIG. 5.

FIG. 6 is a transverse sectional view of brush body 22 as seen from line 6—6 of FIG. 5. FIG. 6 shows a portion of head 26 between sides 26D and 26C including ribs 30A, 30B, 30C, 30D, 30E, 30F, and 30G, and steps 32A and 32G, and shelves 33A and 33B.

Ribs 30A–30G are shown between sides 26D and 26C of head 26 and extend into the page. Rib 30D is fixed at the center of head 26 relative to sides 26D and 26C. Ribs 30E–30G are evenly spaced from rib 30D toward side 26C of head 26. Similarly, ribs 30A–30C are evenly spaced from rib 30D to side 26D of head 26. In one embodiment, ribs 30A–30G are 0.07 inches wide separated by 0.14 inches. Ribs 30B–30F have a height so that the lower surface of each rib is parallel to each other rib in the horizontal direction. In one embodiment, rib 30D is 0.53 inches high. Ribs 30A and 30G are shorter than the other ribs so that the lower surface of both ribs 30A and 30G are parallel to the lower surface of each other rib in the horizontal direction.

Shelf 33A is attached between side 26D and rib 30A. Shelf 33A is situated so that its lower surface is parallel to the lower surfaces of ribs 30A-30G in the horizontal direction. Similarly, shelf 33B is attached between side 26C and rib 30G. Its lower surface is also situated to be parallel with the lower surfaces of ribs 30A-30G in the horizontal direction. The lower surfaces of shelves 33A and 33B along with ribs 30A-30G establish a flat surface upon which bristle insert 24 rests.

Step 32A is attached to side 26D, the lower surface of shelf 33A, and the lower surface of rib 30A. Similarly, step 32G is attached to side 26C, the lower side of shelf 33B and to the lower surface of rib 30G. In one embodiment, steps 32A and 32G have a height of 0.16 inches.

Figure 7:
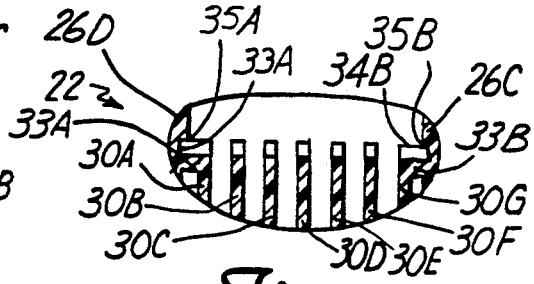
FIG. 7 is a sectional view as seen from line 7—7 of FIG. 5.

FIG. 7 is a transverse sectional view of brush body 22 as seen from line 7—7 of FIG. 5. FIG. 7 shows a portion of head 26 between sides 26D and 26C including ribs 30A-30G, shelves 33A and 33B, notches 34A and 34B, and shoulders 35A and 35B.

Ribs 30A-30G are shown between sides 26D and 26C of head 26. Ribs 30B-30F have a height so that the lower surface of each rib is flush with the lower surfaces of the other ribs. Ribs 30A and 30G are shorter than the other ribs so that the lower surface of both rib 30A and rib 30G are equal to the other ribs.

Shelf 33A is connected between side 26D and rib 30A. The lower surface of shelf 33A is situated so that it is parallel with the lower surfaces of ribs 30A-30G in the horizontal direction. Similarly, shelf 33B is attached between side 26C and rib 30G with its lower surface parallel with the lower surfaces of ribs 30A-30G.

Notch 34A is set back into side 26D. Notch 34A is set back into side 26D a sufficient distance so that shoulder 35A is formed. Shoulder 35A aides in the interconnection of head 26 with bristle insert 24 (as explained later). Similarly, notch 34B is set back into side 26C. Notch 34B is set back into side 26C a sufficient amount so that shoulder 35B is formed. Shoulder 35B also aides in the interconnection of head 26 with bristle insert 24 (as explained later).

Figure 8:
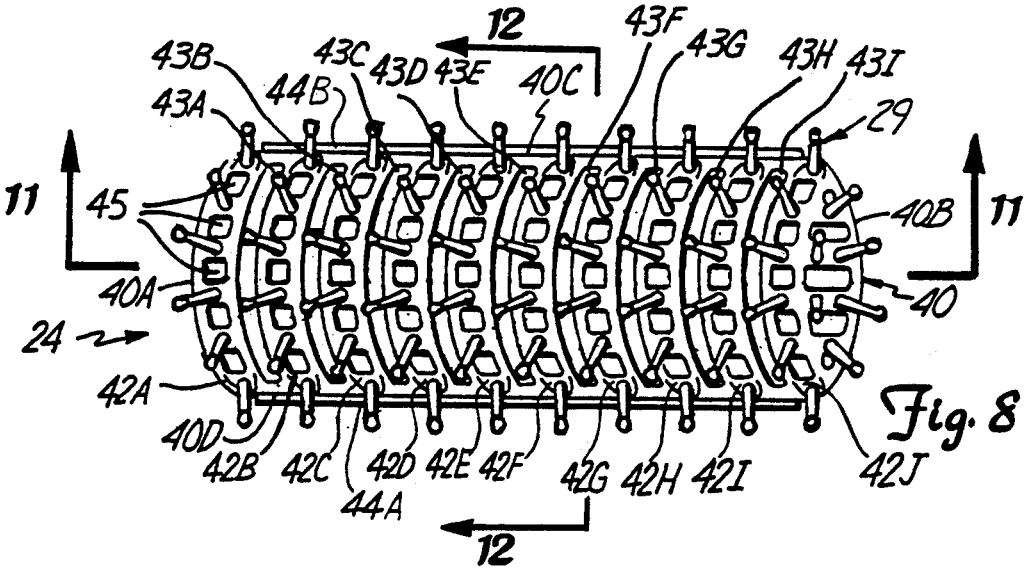
FIG. 8 is a bottom view of the bristle insert in accordance with the present invention.
Figure 9:
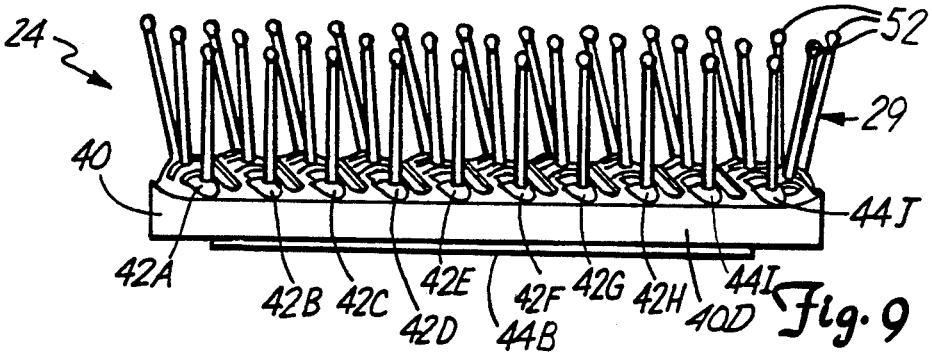
FIG. 9 is a side view of the bristle insert.
Figure 10:
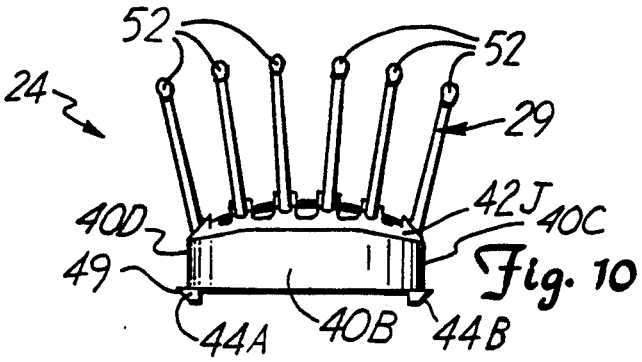
FIG. 10 is an end view of the bristle insert.

FIGS. 8-10 show bristle insert 24 in an inverted position compared to FIGS. 1 and 4. Bristle insert 24 includes block frame 40, webs 42A-42J, wedges 44A and 44B, air slots 43A-43I, and bristles 29 attached on each web.

FIG. 8 is a bottom view of bristle insert 24. Insert frame 40 is an elongated open frame having ends 40A and 40B and sides 40C and 40D. Web 42A extends from side 40D of insert frame 40 to side 40C of insert frame 40 proximate to end 40A of insert frame 40. Web 42A is shaped in a convex configuration so that its center (i.e., half way between sides 40C and 40D of insert frame 40) extends below insert frame 40. Web 42B also extends from side 40D of insert frame 40 to side 40C in a convex shape, but spaced a distance from web 42A toward end 40B of insert frame 40. Each consecutive web (42C-42J) also extends from side 40D of insert frame 40 to side 40C in convex shapes leaving spaces between each web. Web 42J extends from side 40D to side 40C of insert frame 40 proximate to end 40B of insert frame 40.

The positioning of webs 42A-42J leaves a series of spaces to define a second set of transverse air slots in bristle insert 24. Transverse air slots 43A-43I are shown alternating between webs 42A-42J. Transverse air slots 43A-43I cooperate with longitudinal air slots 31A-31F to provide an extreme open structure through which air is allowed to flow freely.

Bristle insert 24, consisting of a series of convex webbed portions between insert frame 40, provides several advantages. First, when pressure is applied to bristles 29, webs 42A-42J will give way and provide a cushion. The convex shape of the webs allows each web to bend away from the pressure. Thus, in operation, hairbrush 20 is comfortable to the user in that bristles 29 will bend away from the user rather than poke into the user's scalp. Second, since bristles 29 are provided a cushion by the flexibility of webs 42A-42J, they will tend to bend back rather than break off when pressure is applied. This adds to the longevity of hairbrush 20. Additional flexibility of webs 42A-42J is obtained by making them thinner. Third, by spreading much of the flexibility to webs 42A-42J, memory is greatly improved. Since webs 42A-42J are anchored at both sides and, thus, are driven to return to their original shape, the webs have excellent memory. On the other hand, bristles 29 are free at the terminal end and are not nearly as inclined to return to their original shape once required to bend. Thus, by deriving most of the flexibility of hair brush 20 from the webs rather than the bristles, the overall memory is greatly improved.

Bristles 29 are affixed to each web of bristle insert 24. They are spaced from side 40D of insert frame 40 to side 40C of insert frame 40 along webs 42A-42J and extend outward therefrom. Alternating with bristles 29 on each of webs 42A-42J are holes 45. Holes 45, in combination with air slots 43A-43I, provide additional space for air to flow through hairbrush 20. They also add to the cushion effect of bristle insert 24.

Wedges 44A and 44B are shown attached to sides 40D and 40C, respectively, of insert frame 40. Each of the wedges are connected to the bottom of insert frame 40 and extend downward therefrom. Wedges 44A and 44B are shaped so that they fit over shoulders 35A and 35B of head 26 which allows bristle insert 24 to interconnect with head 26.

FIG. 9 is a side view of bristle insert 24 in an inverted position. Side 40D of insert frame 40 is shown with webs 42A-42J extending therefrom. Bristles 29 are shown carried on the webs. Bristles 29 are angled in various directions. The injection molding process allows for a multitude of possible angles at which bristles 29 can extend from webs 42A-42J. The process also allows for various combinations of angles for each individual bristle. For example, the bristles adjacent to side 40D of insert frame 40 can be angles at 20° relative to the vertical direction, while the bristles near the center of insert frame 40 can be nearly 0° in the vertical direction. Wedge 44A is shown attached to the bottom of insert frame 40 and extends downward therefrom.

Molding bristles 29 at various combinations of angles for each individual bristle is important to avoid straight lines left in the hair of the user. When bristles extend straight up from the webbing at identical angles they tend to follow directly behind each other. When the bristles are angled individually at differing angles no straight paths are left for hair to pass directly through. Thus, a more true brushing action is achieved.

FIG. 10 is an end view of bristle insert 24 in an inverted position. End 40B of insert frame 40 is shown with web 42J extending between side 40C and side 40D.

Bristles 29 are shown connected to web 42J. Wedges 44A and 44B are shown connected to the bottom of insert frame 40. Wedge 44A has lip 49, which extends beyond side 40D of insert frame 40. Lip 49 aides in the interconnection of bristle insert 24 with head 26.

Figure 11:
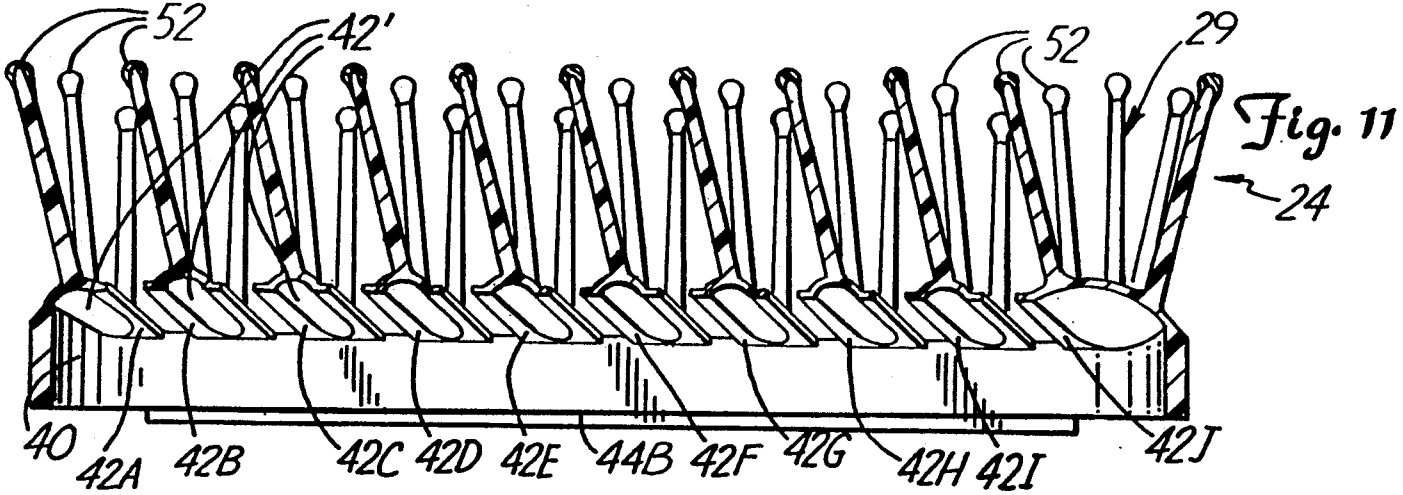
FIG. 11 is a sectional view as seen from line 11—11 in FIG. 8.

FIG. 11 is a sectional view as seen from line 11—11 in FIG. 8. Insert frame 40 is shown with webs 42A–42J extending therefrom. Grooves 42' are shown on the underside of webs 42A–42J. Grooves 42' create an arcuate cross-section in webs 42A–42J, which adds to the overall strength of webs 42A–42J. Bristles 29 are shown attached to webs 42A–42J extending upward therefrom. Wedge 44B is shown connected to insert frame 40 and extends downward therefrom.

Figure 12:
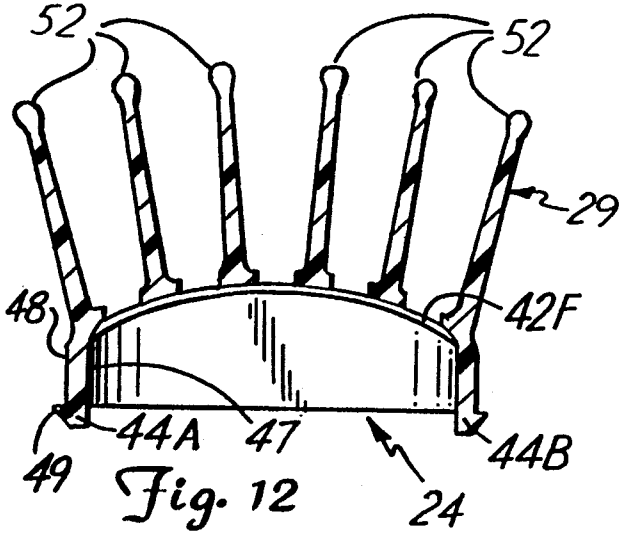
FIG. 12 is a sectional view as seen from line 12—12 in FIG. 8.

FIG. 12 is a transverse sectional view as seen from line 12—12 in FIG. 8. Web 42F is shown extending in a convex shape. Bristles 29 are connected to the top of web 42F and extend upward therefrom at various angles. Wedges 44A and 44B are shown connected proximate to each end of web 42F and extend downward therefrom. In one embodiment, web 42F is 0.52 inches thick. Bristles 29 have a 0.07 inch diameter at their base, and a 0.05 inch diameter at their top. Bristle insert 24 is 0.47 inches in height, measured in the middle of bristle insert 24, and 1.45 inches wide.

Inner wall 47 of wedge 44A is flat. Outer wall 48 of wedge 44A, however, has a small outjutting lip 49 at the bottom. Lip 49 allows bristle insert 24 to lock into head 26 of brush body 22. As will be described later, lip 49 of wedge 44A fits over a solid portion of head 26 so that bristle insert 24 and head 26 cannot easily be separated.

Figure 13:
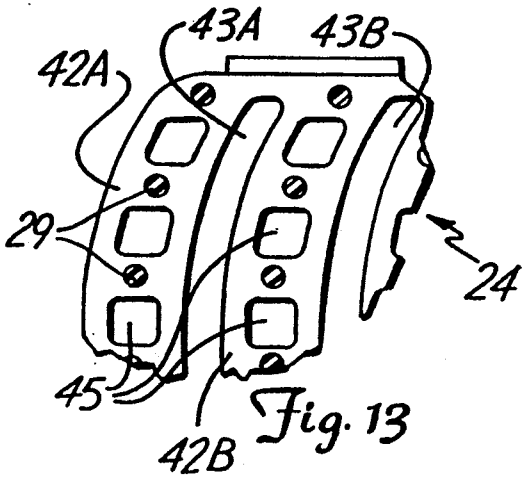
FIG. 13 is a greatly enlarged fragmentary detail of a portion of FIG. 8 illustrating the bristle insert.
Figure 14:
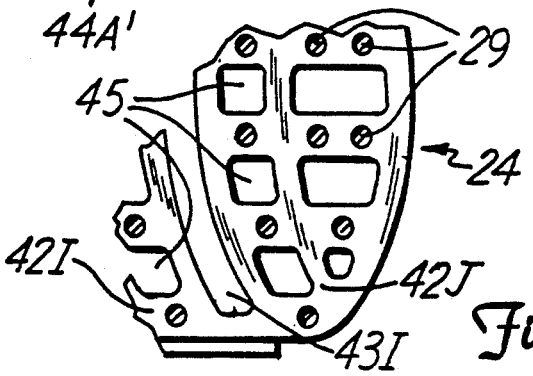
FIG. 14 is also a greatly enlarged fragmentary detail of a portion of FIG. 8 illustrating the bristle insert.

FIGS. 13 and 14 are greatly enlarged fragmentary details of a portion of FIG. 8 illustrating bristle insert 24. FIG. 13 shows web 42A and web 42B separated by air slot 43A. On both web 42A and web 42B, bristles 29 are alternated with holes 45. Holes 45, along with air slots 43A–43I, provide bristle insert 24 with maximum flexibility and also allow airflow through bristle insert 24. Similarly, FIG. 14 shows webs 42I and 42J. Webs 42I and 42J are separated by air slot 43I and alternate bristles 29 with holes 45 on their surfaces. Airflow through bristle insert 24 is important so that air may be blown through hairbrush 20 onto the user's hair.

Figure 15:
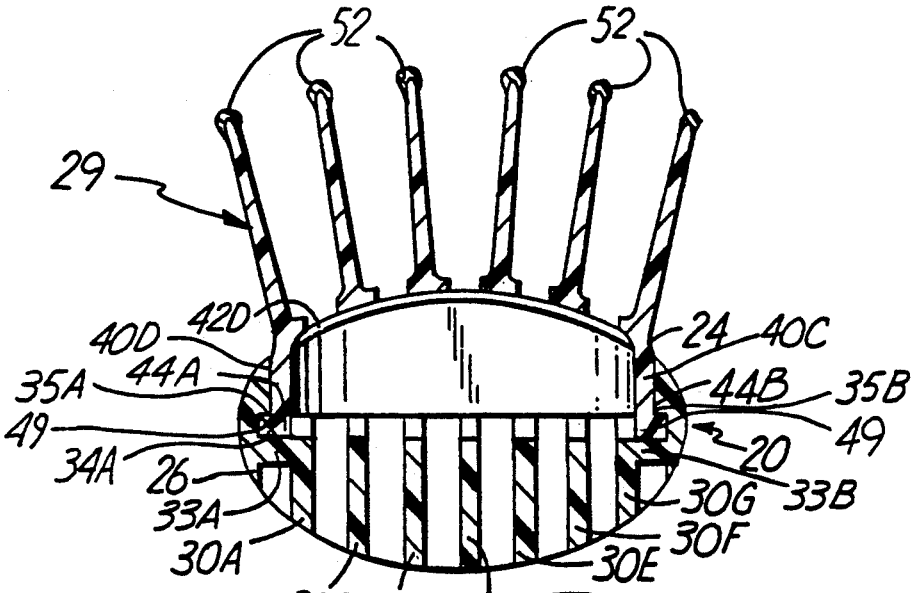
FIG. 15 is a transverse sectional view as seen from line 15—15 of FIG. 3.

FIG. 15 is a transverse sectional view as seen from line 15—15 of FIG. 3. Bristle insert 24 is interconnected with head 26. Ribs 30A–30G are shown extending across head 26. Shelves 33A and 33B are shown extending from ribs 30A and 30G, respectively. Bristles 29 are shown carried on web 42D which extends from side 40D to side 40C of insert frame 40.

Wedge 44A is shown within notch 34A. Lip 49 of wedge 44A engages shoulder 35A. Similarly, lip 49 of wedge 44B engages shoulder 35B. Lip 49 fits over shoulders 35A and 35B so that bristle insert 24 cannot easily be removed from head 26. In this way, bristle insert 24 and head 26 are interconnected.

Bristles 29 have a rounded top 52. Top 52 is created by dipping bristles 29 in paint and allowing the paint to dry. This assures that the ends of bristles 29 are smooth and will not injure or irritate the scalp of the user.

Figure 16:
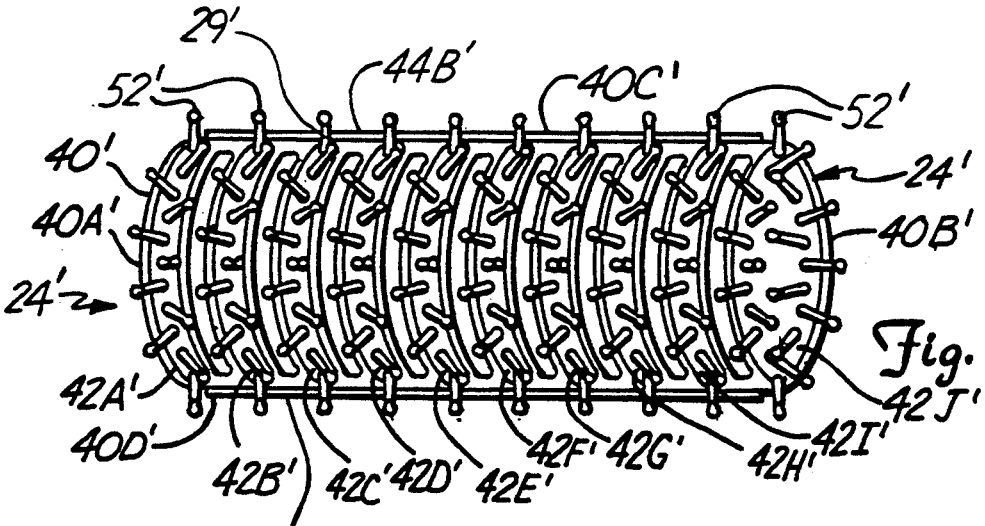
FIG. 16 is a top view of an alternative embodiment of the bristle insert in accordance with the present invention.

FIG. 16 is an alternative embodiment of bristle insert 24' in accordance with the present invention. Webs 42A'–42J' are shown extending between sides 40D' and 40C' of insert frame 40'. Bristles 29' are carried on webs 42A'–42J'. Thus, bristle insert 24' has nearly double the bristles of bristle insert 24 and no holes in the webs themselves.

Bristle insert 24' of FIG. 16 is just one example of alternative bristle inserts that may used with the body of the present invention. Thus, a multitude of various bristle inserts, each providing different characteristics, may be interconnected with the body of the present invention. For example, an alternative bristle insert can comprise a insert which is made up of nylon tufted bristles.

The hairbrush of the present invention introduces a multitude of improvements to the art. The advantageous qualities of brushes with nylon tufted bristles are retained, while all the disadvantages are avoided. For example, the labor involved in individually tufting the bristles of nylon tufted brushes as well as the higher material costs of nylon have been avoided. These two factors dictate that the hairbrush of the present invention is less expensive to manufacture than comparable brushes on the market. Using polypropylene or a polypropylene/elastomer alloy instead of nylon is a significant cost savings in material. Nylon can be as much as three times as expensive as polypropylene.

The present invention utilizes a very open structure. This open structure maximizes the air flow through the hair brush while at the same time it minimizes the amount of plastic that must be used to construct the hairbrush. This leads to a lighter weight and lower costing hairbrush. In addition, open structure design allows the user to quickly remove any strands of hair left in the brush through normal hair loss. Similarly, the groove and rib grip gives a secure grip to the user, while at the same time it minimizes the weight and material needed for the hairbrush. In addition, the injection molding and snap-together design allow for easy assembly and make the hairbrush inexpensive to manufacture. Finally, the present invention has removed the short stub which was present in the base of some of the nylon tufted bristles, and also allows the bristles to be formed at angles which was not possible with the nylon tufted bristles.

While the present invention has met the shortcomings of brushes with nylon tufted bristles, it has also retained the advantages as well. The web design of the brush allows for maximum flexibility to provide a cushion effect to the brush. This allows for comfort to the user and also allows the bristles to bend away rather than break upon impact. In addition, the design of the brush allows maximum airflow through the brush which is important in styling.

In addition to these improvements, the present invention provides a brush that is durable, aesthetically pleasing, and has surfaces that are smooth and remain so even after being subjected to harsh conditions.

Although the present invention has been described with reference to preferred embodiments, workers skilled in the art will recognize that changes may be made in form and detail without departing from the spirit and scope of the invention.

What is claimed is:

1. A hairbrush comprising:

a brush body which includes:

a head having first and second ends and first and second sides which form an open frame and a plurality of ribs which extend between the first and second ends to define a first set of air slots; and a handle having first and second ends with the first end of the grip attached to the second end of the head; and a bristle insert which includes:

an open frame with first and second sides and first and second ends;

a plurality of convex webs extending directly and without intersection between the first and second sides of the open frame, the webs being spaced from one another to define a second set of air slots, the second set of air slots extending directly and without interruption between the first and second sides of the open frame;

a plurality of spaced bristles carried on each of the webs, the bristles extending outward from the webs; and a connector for mating with the frame of the head to connect the bristle insert to the head.

2. The apparatus of claim 1 wherein the handle is narrower than the head.

3. The apparatus of claim 1 wherein the brush body and bristle insert are each one piece injection molded.

4. The apparatus of claim 3 wherein the brush body and bristle insert are each one piece injection molded with a polypropylene-containing material.

5. The apparatus of claim 1 wherein the webs contain holes between the adjacent bristles.

6. The apparatus of claim 1 wherein the bristles are configured such that they do not form a straight line from the first side to the second side of the head.

7. The apparatus of claim 1 wherein the bristles extend outward from the webs at various angles with respect to the webs.

8. A hair brush comprising:

a one-piece injection-molded brush body comprising a head and a handle; and a one-piece injection-molded bristle insert comprising:

a webbed portion which alternates web strips with spaces, the spaces continuing without interruption from a first side of the bristle insert to a second side of the bristle insert opposite the first side;

a plurality of bristles extending upward at various angles from the web strips in the webbed portion; and snap connection means running along side the webbed portion for connecting the bristle insert to the head.

9. A hairbrush comprising:

a head having alternating ribs with open spaces;

a handle connected to the head for holding the hairbrush; and an insert for connection with the head with a plurality of convex webs alternating with open spaces and a plurality of bristles carried on the webs, the convex webs extending uninterrupted from one side of the insert to an opposite side of the insert and the open spaces likewise extending uninterrupted from one side of the insert to an opposite side of the insert.

10. The apparatus of claim 9 wherein the head and the handle are one piece, injection-molded, and made with a polymeric material.

11. The apparatus of claim 10 wherein the polymeric material includes polypropylene.

12. The apparatus of claim 9 wherein the insert is injection-molded with a polymeric material.

13. The apparatus of claim 12 wherein the polymeric material includes polypropylene.

* * * * *

UNITED STATES PATENT AND TRADEMARK OFFICE

CERTIFICATE OF CORRECTION

PATENT NO. : 5,327,611

DATED : July 12, 1994

INVENTOR(S) : MELVIN E. BALSTER, DELTON A. KRUSCHKE

It is certified that error appears in the above-indentified patent and that said Letters Patent is hereby corrected as shown below:

Col. 4, line 28, delete "Steps 321'432M", insert --Steps 32I-32M--

Col. 4, line 29, delete "Steps 321-32M", insert --32I-32M--

Col. 6, line 53, after "20°", insert --,--

Signed and Sealed this

Twenty-seventh Day of December, 1994

*Attest:*

Bruce Lehman

BRUCE LEHMAN

*Attesting Officer*

*Commissioner of Patents and Trademarks*